US010801520B2

(12) United States Patent
Sano et al.

(10) Patent No.: US 10,801,520 B2
(45) Date of Patent: Oct. 13, 2020

(54) CENTRIFUGAL TURBO MACHINERY

(71) Applicant: MITSUBISHI HEAVY INDUSTRIES, LTD., Tokyo (JP)

(72) Inventors: Takeshi Sano, Tokyo (JP); Taiki Asahara, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 170 days.

(21) Appl. No.: 16/102,971

(22) Filed: Aug. 14, 2018

(65) Prior Publication Data

US 2019/0055956 A1 Feb. 21, 2019

(30) Foreign Application Priority Data

Aug. 16, 2017 (JP) ..... 2017-157052

(51) Int. Cl.

| | |
|---|---|
| ***F04D 29/68*** | (2006.01) |
| ***F04D 29/22*** | (2006.01) |
| ***F04D 17/08*** | (2006.01) |
| ***F04D 29/44*** | (2006.01) |
| ***F04D 29/28*** | (2006.01) |
| ***F04D 1/06*** | (2006.01) |

(52) U.S. Cl.

CPC ..... *F04D 29/688* (2013.01); *F04D 1/063* (2013.01); *F04D 17/08* (2013.01); *F04D 29/2261* (2013.01); *F04D 29/2266* (2013.01); *F04D 29/2272* (2013.01); *F04D 29/284* (2013.01); *F04D 29/44* (2013.01); *F04D 29/681* (2013.01); *F05D 2240/14* (2013.01); *F05D 2250/184* (2013.01)

(58) Field of Classification Search

CPC .. F04D 29/284; F04D 29/681; F04D 29/2272; F04D 1/063; F04D 29/688

See application file for complete search history.

(56) References Cited

U.S. PATENT DOCUMENTS

| | | | | |
|---|---|---|---|---|
| 3,447,475 A * | 6/1969 | Blum | F04D 7/045 415/121.1 |
| 5,106,262 A * | 4/1992 | Oklejas | F01D 5/048 415/111 |
| 5,167,678 A * | 12/1992 | Elonen | F04D 9/003 415/169.1 |
| 5,209,652 A * | 5/1993 | Fischer | F04D 29/0413 384/103 |

(Continued)

FOREIGN PATENT DOCUMENTS

| | | |
|---|---|---|
| JP | 2-78786 A | 3/1990 |
| JP | 3-11198 A | 1/1991 |

(Continued)

*Primary Examiner* — Woody A Lee, Jr.

(74) *Attorney, Agent, or Firm* — Westerman, Hattori, Daniels & Adrian, LLP

(57) ABSTRACT

A centrifuge turbo machinery includes an impeller which rotates about an axis to pressure-feed fluid flowing along the axis to an outer side in a radial direction, and a casing which accommodates the impeller and has a facing surface facing the impeller in an axial direction. A convex portion relatively close to the impeller and extending in the radial direction and a concave portion relatively spaced apart from the impeller and extending in the radial direction are alternately and continuously formed on the facing surface in a circumferential direction.

4 Claims, 5 Drawing Sheets

(56) References Cited

U.S. PATENT DOCUMENTS

| | | | | | |
|---|---|---|---|---|---|
| 5,240,372 | A * | 8/1993 | Krienke | F04D 29/2261 | 415/116 |
| 5,320,482 | A | 6/1994 | Palmer et al. | | |
| 5,984,629 | A | 11/1999 | Brodersen et al. | | |
| 6,139,260 | A * | 10/2000 | Arbeus | F04D 29/183 | 415/121.2 |
| 6,158,959 | A * | 12/2000 | Arbeus | F04D 29/242 | 415/204 |
| 6,464,454 | B1 * | 10/2002 | Kotkaniemi | F04D 7/045 | 415/121.1 |
| 9,896,965 | B2 * | 2/2018 | McAuliffe | F16C 37/00 | |
| 2008/0085181 | A1 | 4/2008 | Hanai | | |
| 2015/0037146 | A1 * | 2/2015 | Yamaguchi | F01D 11/025 | 415/174.5 |

FOREIGN PATENT DOCUMENTS

| | | | |
|---|---|---|---|
| JP | 2005-090478 | A | 4/2005 |
| JP | 2006-057487 | A | 3/2006 |
| JP | 2008-95511 | A | 4/2008 |
| JP | 2016-142257 | A | 8/2016 |

* cited by examiner

CENTRIFUGAL TURBO MACHINERY

CROSS-REFERENCE TO RELATED APPLICATIONS

Priority is claimed on Japanese Patent Application No. 2017-157052, filed Aug. 16, 2017, the content of which is incorporated herein by reference.

BACKGROUND OF THE INVENTION

Field of the Invention

The present invention relates to a centrifugal turbo machinery.

Description of Related Art

In an impeller of a centrifugal turbo machinery, a leakage loss occurs due to fluid leakage to a gap of an impeller rear side, and in addition, a friction loss (a disc friction loss) due to rotation of the disc in water occurs. Since the disc friction loss is small in a low-pressure pump, the influence of the disc friction loss can be neglected. However, in a high-pressure pump (an injection pump, an electric submersible pump (ESP), a water supply pump, and the like) for which there is great need for petroleum gas, chemical plants and the like, an outer diameter of the impeller tends to increase, and a fraction accounted for by the disc friction loss with respect to a total loss increases, which becomes a main cause of deterioration in efficiency. In general, in a multi-stage pump, a method of increasing the number of pump stages to decrease the pressure per pump stage and reduce the outer diameter of the impeller of each pump is performed. However, in this case, a shaft becomes long. Therefore, the number of pump stages is limited due to a restriction of the shaft vibration.

The disc friction loss is caused by rotation of a large-diameter disc in the fluid. In order to reduce the disc friction loss, it is necessary to reduce the speed difference between the fluid flowing through a gap on the impeller rear side and the disc or to keep a boundary layer (velocity distribution) on a side in front of a disc in an appropriate form. Japanese Unexamined Patent Application, First Publication No. H3-11198 discloses a method for reducing the disc friction loss.

In Japanese Unexamined Patent Application, First Publication No. H3-11198, it is suggested to divide the impeller rear side into a plurality of spaces to control the velocity distribution of the gap on the impeller rear side. However, in the configuration disclosed in Japanese Unexamined Patent Application, First Publication No. H3-11198, since a dimensionally small portion is formed, it is difficult to control the size, and a complicated configuration is required, which leads to an increase in manufacturing costs.

SUMMARY OF THE INVENTION

The present invention provides a centrifugal turbo machinery capable of reducing a speed difference between a rotating disc and a fluid around the rotating disc, without having a complicated structure.

A centrifugal turbo machinery according to an aspect of the present invention includes: an impeller which rotates about an axis to pressure-feed fluid flowing along the axis to an outer side in a radial direction; and a casing which accommodates the impeller and has a facing surface facing the impeller in an axial direction, wherein a convex portion relatively close to the impeller and extending in the radial direction and a concave portion relatively spaced apart from the impeller and extending in the radial direction are alternately and continuously formed on the facing surface in a circumferential direction.

According to this configuration, since the convex portion and the concave portion are alternately and continuously formed in the circumferential direction, the distance between the impeller and the casing can be changed.

In the centrifugal turbo machinery, the impeller may include a disc fixed to a shaft for rotating the impeller, a plurality of blades provided on the disc, and a cover which covers the blade, and the facing surface may have a surface facing the disc in the casing in the axial direction, and a surface facing the cover in the casing in the axial direction.

According to this configuration, it is possible to change the distance between the cover, the disc and the casing at the front and rear of the impeller in the axial direction.

In the centrifugal turbo machinery, the convex portion and the concave portion may be formed in an entire region of a portion of the facing surface facing the disc and an entire region of a portion of the facing surface facing the cover.

According to this configuration, it is possible to change the distance between the impeller and the casing in a wider range.

In the centrifugal turbo machinery, the convex portion and the concave portion may be formed only in a partial region of the facing surface facing the disc on a radially outer side in the radial direction and a partial region of the facing surface facing the cover on a radially outer side in the radial direction.

According to this configuration, the formation range of a waveform portion can be reduced, and it is possible to change the distance between the impeller and the casing in a region in which the speed difference between the impeller and the fluid located between the impeller and the casing is likely to increase.

In the centrifugal turbo machinery, an inclination from a bottom end of the concave portion to a protruding end of the convex portion of the impeller in the rotational direction may be greater than an inclination from a protruding end of the convex portion to a bottom end of the concave portion of the impeller in the rotational direction.

According to this configuration, when the speed of the fluid between the impeller and the casing is increased, the distance between the impeller and the casing can be rapidly decreased, and when the speed of the fluid between the impeller and the casing is slowed down, the distance between the impeller and the casing can be gradually reduced.

According to the centrifugal turbo machinery of the present invention, since the distance between the impeller and the casing can be changed by a convex portion and a concave portion provided in the casing, it is possible to reduce the speed difference between the impeller and the fluid between the impeller and the casing and to reduce disc friction loss with a simple configuration.

DETAILED DESCRIPTION OF THE INVENTION

First Embodiment

Hereinafter, a first embodiment in which the centrifugal turbo machinery of the present invention is configured as a multi-stage pump will be described with reference to the accompanying drawings.

Figure 1:
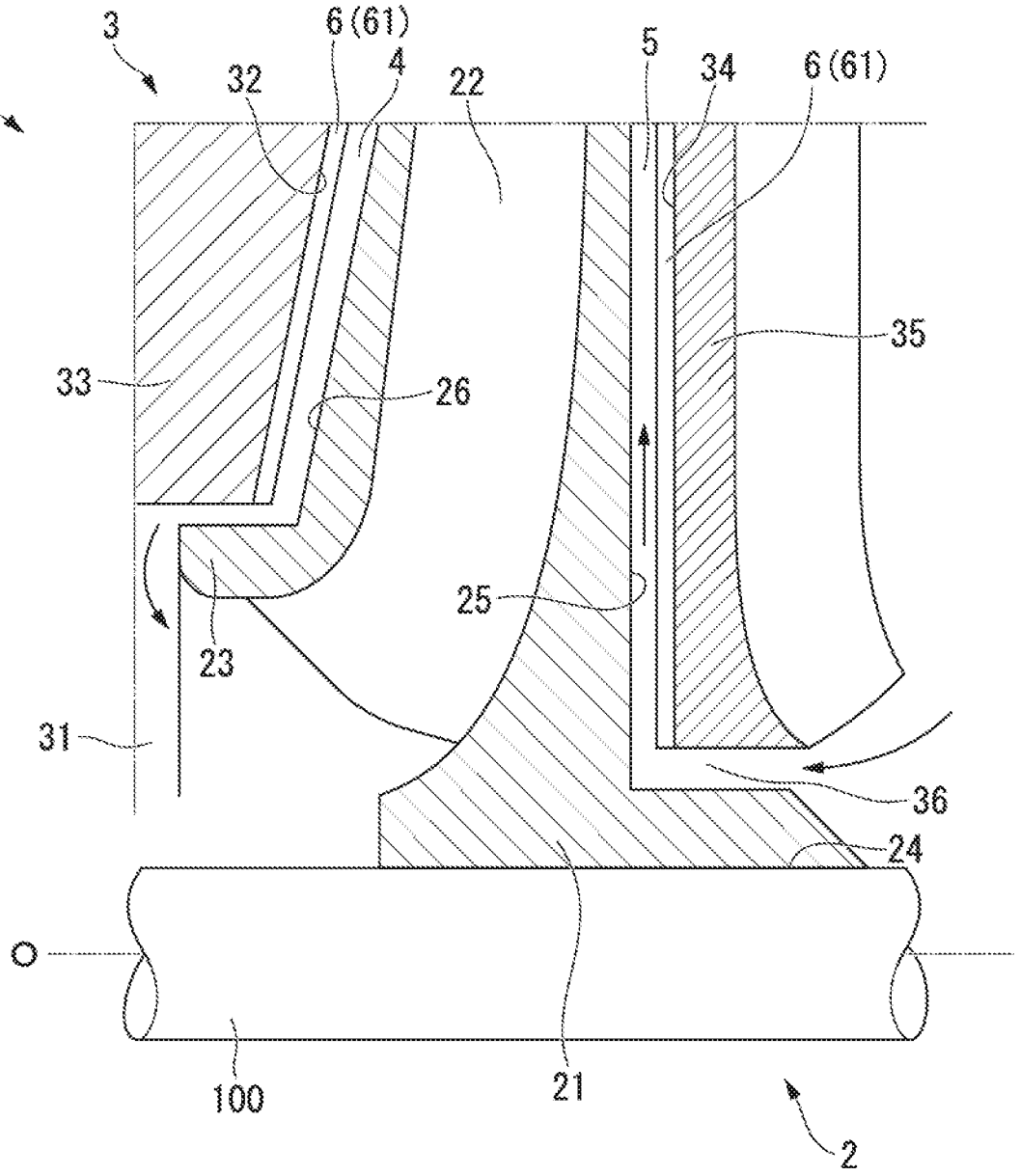
FIG. 1 is an axial cross-sectional view of a centrifugal turbo machinery according to a first embodiment of the present invention.

As illustrated in FIG. 1, a centrifugal turbo machinery 1 includes a shaft 100 having an axis O, an impeller 2 fixed to the shaft 100 to be rotatable together with the shaft 100, and a casing 3 provided with a suction port 31 and accommodating the impeller 2. In the present specification, a direction toward the suction port 31 of the casing 3 with respect to the impeller 2 in an axial direction of the impeller 2 is defined as forward, and a direction toward an opposite side of the suction port 31 of the casing 3 with respect to the impeller 2 in the axial direction of the impeller 2 is defined as rearward.

The impeller 2 includes a disc 21 having a substantially disc shape when viewed in the axial direction, a plurality of blades 22 provided on the disc 21, and a cover 23 which covers the blade 22. In this way, the impeller 2 of the present embodiment is a closed impeller. By rotating around the axis O, the impeller 2 pressure-feeds the fluid flowing in via the suction port 31 of the casing 3 in a direction of the axis O to the outer side in the radial direction. The disc 21 has a through-hole 24 through which the shaft 100 penetrates and is fixed. The blade 22 extends from the surface facing the front of the disc 21 in the axial direction. The cover 23 is attached to a side of the blade 22 that is separated from the disc 21. The disc 21 has a rear side 25 facing rearward in the axial direction. The cover 23 has a front side 26 facing forward in the axial direction.

Figure 2:
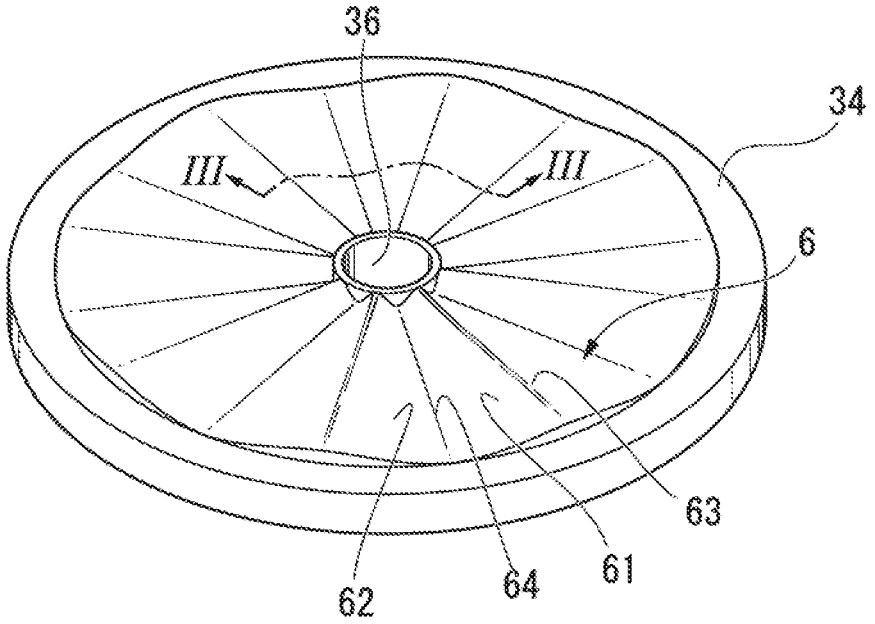
FIG. 2 is a perspective view of a rear part of the casing of the first embodiment of the present invention.
Figure 3:
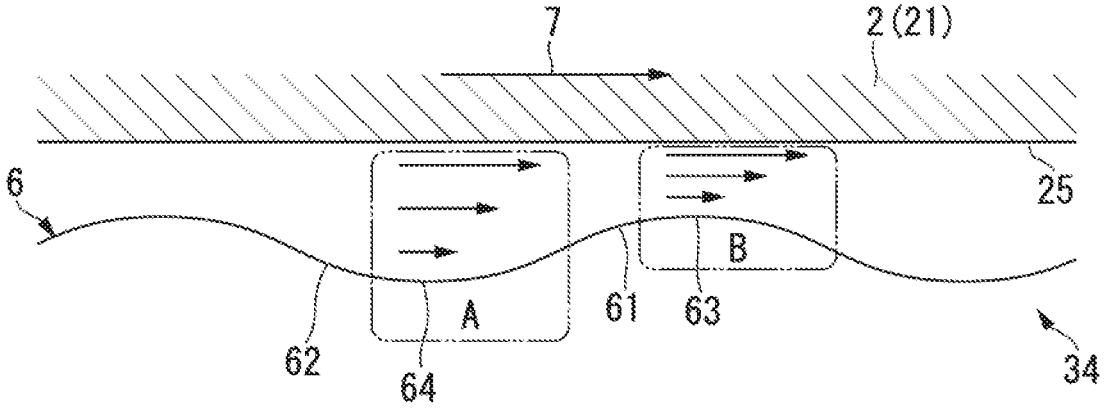
FIG. 3 is a cross-sectional view taken along a line III-III of FIG. 2 and a view illustrating a disc.

The casing 3 includes a front part 33 having a rear side 32 which faces the front side 26 of the cover 23 in the axial direction, and a rear part 35 having a front side 34 which faces the rear side 25 of the disc 21 in the axial direction. In the rear part 35, a gap 36 for preventing contact between the shaft 100 and the casing 3 is formed. As illustrated in FIG. 1, a front gap 4 located in front of the impeller 2 in the axial direction is formed between the front side 26 of the cover 23 and the rear side 32 of the front part 33, and a rear gap 5 located behind the impeller 2 in the axial direction of the impeller 2 is formed between the rear side 25 of the disc 21 and the front side 34 of the rear part 35. Fluid leaking from the impeller 2 during operation of the turbo machinery flows into the front gap 4 and the rear gap 5. FIG. 1 illustrates a configuration in which fluid flows into the front gap 4 inward in the radial direction, and fluid flows into the rear gap 5 outward in the radial direction. On both the rear side 32 and the front side 34, waveform portions 6 are formed along the circumferential direction as illustrated in FIGS. 1 to 3. Since the waveform portions 6 formed on the rear side 32 and the front side 34 are the same, only the waveform portions 6 formed on the front side 34 of the rear part 35 will be described below.

In the present embodiment, the waveform portion 6 is formed in the entire region of a portion of the front side 34 facing the rear side 25 of the disc 21. The waveform portion 6 has a plurality of convex portions 61 relatively close to the rear side 25 and extending in the radial direction, and a plurality of concave portions 62 relatively separated from the rear side 25 and extending in the radial direction. The convex portion 61 has a protruding end 63 located on a foremost side in the axial direction, and the concave portion 62 has a bottom end 64 located on a rearmost side in the axial direction. In the present embodiment, each of the protruding end 63 and the bottom end 64 is formed in a point shape in a circumferential direction. The convex portion 61 and the concave portion 62 are alternately and continuously formed in the circumferential direction so as to be smoothly connected in the circumferential direction. This is because, in a case in which there is a step between the convex portion 61 and the concave portion 62, and therefore, a right angle portion is formed in the convex portion 61 and the concave portion 62, when the fluid moves beyond the convex portion 61 and the concave portion 62, a vortex is generated in the fluid. In the present embodiment, the convex portion 61 and the concave portion 62 are formed in a curved shape when viewed in the radial direction. Each wave of the waveform portion 6 is symmetrically formed, that is, each wave is formed symmetrically with respect to a line passing through the protruding end 63 or the bottom end 64 and parallel to the axis O. Further, in this embodiment, the inner circumferential end of the waveform portion 6 is formed to have a corner in the cross-sectional view of FIG. 1. The number of waves is at least four, and in the present embodiment, eight waves are illustrated as an example. Also, the distance from the protruding end 63 to the bottom end 64 is substantially constant along the radial direction with respect to all the waves.

FIG. 3 is a cross-sectional view taken along line in FIG. 2. In FIG. 3, the disc 21 is also illustrated. In FIG. 3, reference numeral 7 indicates a rotational direction of the disc 21. Therefore, the fluid located in the rear gap 5 also flows along the rotational direction 7. Since the convex portion 61 is relatively close to the rear side 25 and the concave portion 62 is relatively separated from the rear side 25, the distance between the protruding end 63 and the rear side 25 is different from the distance between the bottom end 64 and the rear side 25, and the distance between the bottom end 64 and the rear side 25 is greater than the distance between the protruding end 63 and the rear side 25. The distance between the protruding end 63 and the rear side 25 is 30% to 80% of the distance between the bottom end 64 and the rear side 25 as an example, and is 50% in this embodiment.

In order to reduce the disc friction loss, it is found to be advantageous to apply the radially inward turning speed or the radially outward turning speed to the fluid between the impeller 2 and the casing 3 (in front gap 4 and rear gap 5). In this regard, it is found that application of the radially inward turning speed rather than the radially outward turning speed between the impeller 2 and the casing 3 greatly contributes to reduction of the disc friction loss. That is, in general, the front gap 4 side easily obtains a friction loss reduction effect. In order to increase the speed of the fluid between the impeller 2 and the casing 3, it is usually necessary to accelerate the flow with the impeller 2 or the like, but energy for doing so is required. In the present embodiment, since the distance between the protruding end 63 and the rear side 25 is shorter than the distance between the bottom end 64 and the rear side 25, the speed of the fluid passing between the convex portion 61 and the rear side 25 is higher than the speed of the fluid passing between the concave portion 62 and the rear side 25. In this way, since the speed of the fluid passing between the convex portion 61 and the rear side 25 is high, at the portion in which the convex portion 61 is formed, the difference in speed between the disc 21 and the fluid located in the rear gap 5 decreases. Therefore, in a region A in which the distance between the rear side 25 and the front side 34 is large (a region in which the concave portion 62 is formed), the rotation energy of the impeller 2 is consumed to accelerate the fluid located in the rear gap 5 in the rotational direction as usual. On the other hand, when the fluid flows into a region B in which the distance between the rear side 25 and the front side 34 is small (a region in which the convex portion 61 is formed), the fluid is naturally accelerated, and since the speed difference between the disc 21 and the fluid located in the rear gap 5 decreases, the energy consumed by the disc 21 in accelerating the fluid in the rear gap 5 decreases, and as a result, the disc frictional power decreases.

Since the waveform portions 6 formed on the rear side 32 and the front side 34 are the same as described above, the same action can be provided between the waveform portion 6 formed on the rear side 32 and the front side 26 of the cover 23.

It is conceivable to reduce each of the distance between the rear side 32 and the front side 26 and the distance between the front side 34 and the rear side 25 in the entire circumferential direction, without providing the concave portion 62. However, when the distance between the rear side 32 and the front side 26 and the distance between the front side 34 and the rear side 25 become too small, boundary layers of both the rear side 32 and the front side 26 interfere each other, and boundary layers of both the front side 34 and rear side 25 interfere, respectively, and the loss rather increases. Therefore, it is not possible to reduce the distance between the rear side 32 and the front side 26 and the distance between the front side 34 and the rear side 25 in the entire circumferential direction.

Figure 4:
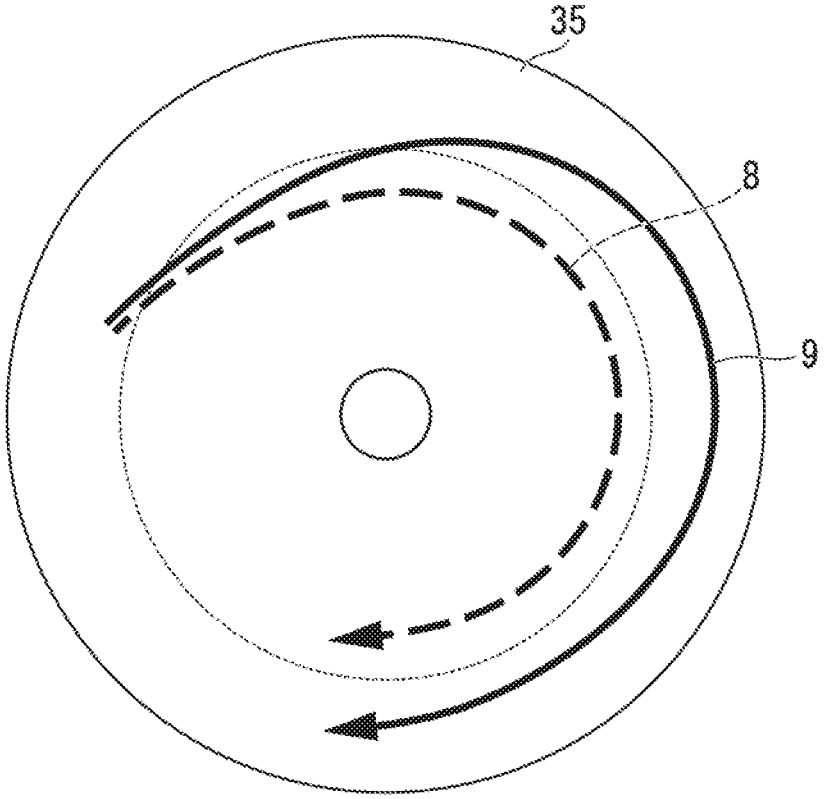
FIG. 4 is a diagram illustrating an effect of a configuration having a waveform portion.

FIG. 4 is a view illustrating the effect obtained by forming the waveform portion 6 in the casing 3, and is a view illustrating the rear part 35 in which the waveform portion 6 is formed when viewed in the axial direction. A dotted line 8 represents the flow of fluid passing through the front gap and the rear gap in the case of using a conventional casing, and a solid line 9 represents the flow of fluid passing through the rear gap 5 in the case of using the casing 3 of the present invention. With refereeing to FIG. 4, it is found that the fluid passing through the rear gap 5 tends to reach the outer side in the radial direction easily by adopting the casing 3 of the present invention. The same effect can be obtained for the fluid passing through the front gap 4.

Further, in the present embodiment, since the waveform portion 6 may be formed in the casing 3 to change the distance between the casing 3 and the impeller 2, there is no need to change the configuration of the conventional impeller 2. Furthermore, since the waveform portions 6 are formed to face both the cover 23 and the disc 21, it is also possible to offset changes in the pressure distribution. In addition, since the waveform portions 6 are provided on the entire portions of the rear side 32 and the front side 34 facing the front side 26 and the rear side 25, the fluid entering the front gap 4 and the rear gap 5 can immediately reach between the convex portion 61 or the concave portion 62, the disc 21 and the cover 23.

Therefore, according to the above embodiment, by forming the waveform portions 6 having the convex portion 61 and the concave portion 62 in the casing 3, it is possible to reduce the disc friction loss without giving unnecessary energy. In addition, since the waveform portions 6 may be formed in the casing 3, it is possible to use a simple impeller 2. Thus, there is an effect of being able to reduce the disc friction loss of the impeller 2 with a simple structure. Further, it is also possible to prevent thrust, by forming the waveform portions 6 to face both the disc 21 and the cover 23 and by offsetting the changes in the pressure distribution. Besides, since the fluid entering the front gap 4 and the rear gap 5 can immediately reach between the convex portion 61 or the concave portion 62, the disc 21 and the cover 23, it is possible to quickly increase the speed of fluid in the front gap 4 and the rear gap 5.

Second Embodiment

A second embodiment of the present invention will be described with reference to FIG. 5. Hereinafter, only components different from those in the first embodiment will be described, and description of the same constituent elements as those of the first embodiment will not be provided. Constituent elements in the second embodiment the same as those in the first embodiment are denoted by the same reference numerals as in the first embodiment.

Figure 5:
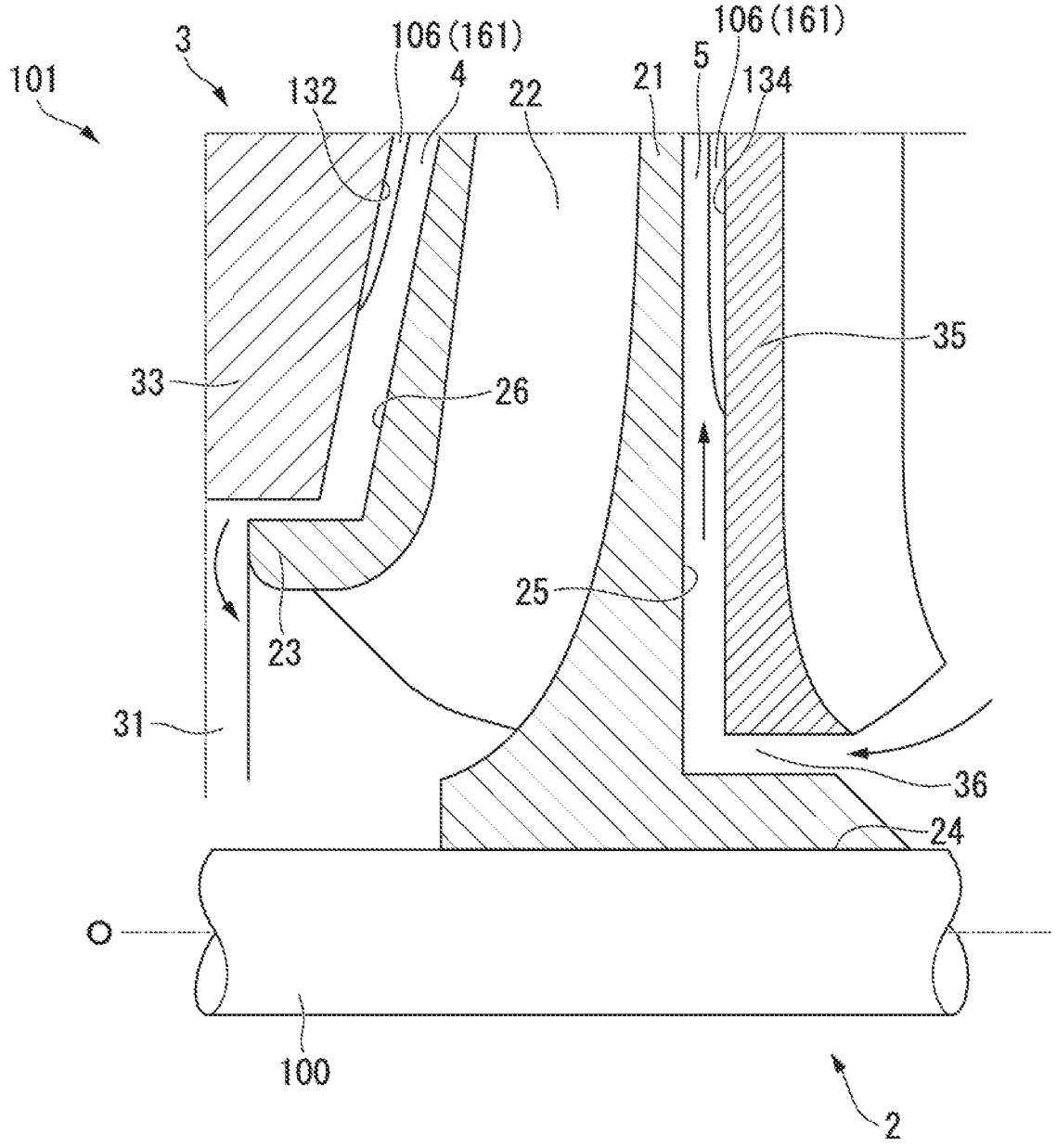
FIG. 5 is an axial cross-sectional view of the centrifugal turbo machinery illustrating an arrangement of waveform portions according to a second embodiment of the present invention.

FIG. 5 is an axial cross-sectional view of the centrifugal turbo machinery 101 illustrating the arrangement of the waveform portions in the second embodiment.

The first embodiment is configured to have waveform portions 6 in the entire regions of the portions of the rear side 32 and the front side 34 facing the front side 26 and the rear side 25. However, in the second embodiment, the waveform portion 106 is formed only in a partial region on the radially outer side of the portions of a rear side 132 and a front side 134 facing the front side 26 and the rear side 25. Further, in the first embodiment, the inner circumferential end of the waveform portion 6 is formed to have a corner. However, in the second embodiment, the inner circumferential end of the waveform portion 106 has a smooth shape in which there is no unevenness.

Since the second embodiment is configured so that the distance between the rear side 132 and the front side 26 and the distance between the front side 134 and the rear side 25 differs only on the outer side in the radial direction, only the fluid reaching the outer side in the radial direction is subjected to acceleration due to the convex portions 161. Since the rotational speed of the impeller 2 increases from the inner side in the radial direction to the outer side in the radial direction, the speed difference between the cover 23 and the fluid located in the front gap 4 and the speed difference between the disc 21 and the fluid located in the rear gap 5 increase toward the outer side in the radial direction. Accordingly, since the speed difference can be reduced in the region in which the speed difference is large, it is advantageous to decrease the distance between the rear side 132 and the front side 26 and the distance between the front side 134 and the rear side 25 in only a partial region on the outer side in the radial direction. Further, since the inner circumferential end of the waveform portion 106 is formed to have smooth so as to reduce concavity and convexity, a turbulence of the fluid in the rear gap 5 can be reduced as much as possible.

Third Embodiment

A third embodiment of the present invention will be described with reference to FIG. 6. Hereinafter, only components different from those in the first embodiment will be described, and description of constituent elements the same as in the first embodiment will be omitted. Reference numerals of the third embodiment which are the same as in the first embodiment denote constituent elements the same as those in the first embodiment.

Figure 6:
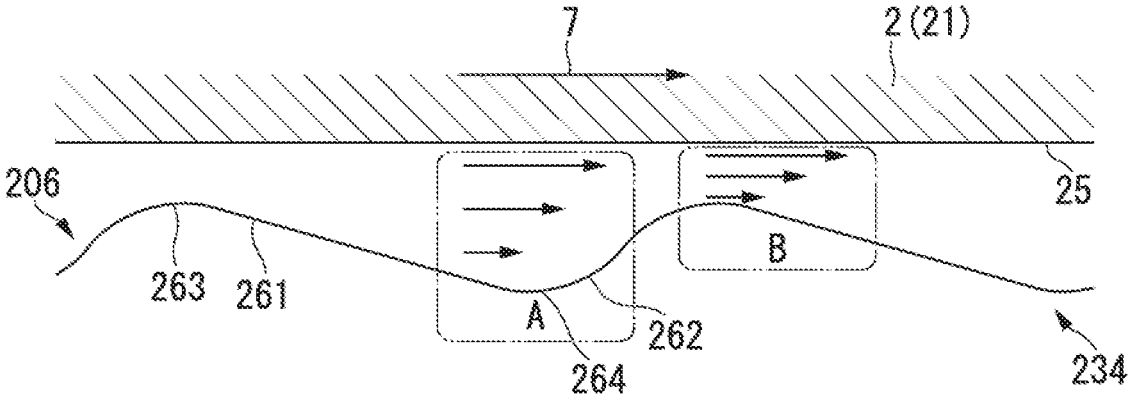
FIG. 6 is a diagram illustrating a relationship between a waveform portion and an impeller according to a third embodiment of the present invention.

FIG. 6 is a diagram illustrating the configuration of the waveform portion 206 in the third embodiment and corresponding to FIG. 3 of the first embodiment.

In the first embodiment, each wave of the waveform portion 6 has a symmetrical configuration, but each wave of the third embodiment is configured asymmetrically. In the third embodiment, as illustrated in FIG. 6, assuming that the impeller 2 rotates in the rotational direction 7, in each wave, the convex portion 261 and the concave portion 262 of the waveform portion 206 formed on the front side 234 have a gentle inclination from the protruding end 263 at the front in the rotational direction to the bottom end 264, and have a steep inclination from the bottom end 264 at the rear in the rotational direction of the impeller 2 to the protruding end 263. That is, in the third embodiment, the inclination from the bottom end 264 to the protruding end 263 in the rotational direction of the impeller 2 is greater than the inclination from the protruding end 263 to the bottom end 264 in the rotational direction of the impeller 2. Although not illustrated, the same also applies to the rear side 232.

Since the inclination from the protruding end 263 to the bottom end 264 in the rotational direction of the impeller 2 is small, occurrence of separation flow can be prevented. Also, since the inclination from the bottom end 264 to the protruding end 263 in the rotational direction of the impeller 2 is large, the cross sections of the front gap 4 and the rear gap 5 sharply decrease, and it is possible to quickly increase the speed of the fluid located in the front gap 4 and the rear gap 5. The configuration of the waveform portion 206 of the third embodiment is also applicable to the second embodiment.

Although the embodiments of the present invention have been described in detail with reference to the drawings, the specific configuration is not limited to this embodiment, and design changes and the like within the scope not deviating from the gist of the present invention are also included.

Several modified examples of the above embodiment will be described below.

In the first embodiment, the inner circumferential end of the waveform portion 6 is formed to have a corner. However, as in the second embodiment, the inner circumferential end of the waveform portion 6 may have a smooth shape having no concavity and convexity. In the case in which the waveform portion 106 is formed only on the outer side in the radial direction as in the second embodiment, if the inner circumferential end of the waveform portion 106 has a corner, turbulence of the fluid occurs at the inner circumferential end (the inner circumferential end located in the rear gap 5) of the waveform portion 106 facing the flow of fluid. Therefore, in the case in which the waveform portion 106 is formed only on the outer side in the radial direction, it is desirable that the inner circumferential end of the waveform portion 106 have a smooth shape having on concavity and convexity.

In the first to third embodiments, both the convex portions 61 and 261 and the concave portions 62 and 262 are formed in a point shape in the circumferential direction, but they may be formed to extend in the circumferential direction by a predetermined distance. As a result, it is possible to maintain a section for increasing the speed of the fluid between the impeller 2 and the casing 3 at a predetermined distance. Also, in the first to third embodiments, the convex portions 61 and 261 and the concave portions 62 and 262 are formed in a curved shape when viewed in the radial direction, but as long as the convex portions 61 and 261 and the concave portions 62 and 262 are smoothly connected and do not have a step, the convex portion and the concave portion may be formed in a straight shape when viewed in the radial direction. Further, in the first to third embodiments, the distance from the concave portions 62 and 262 to the convex portions 61 and 261 is substantially constant over the entire length along the radial direction, but the distance from the concave portions 62 and 262 to the convex portions 61 and 261 may be configured to gradually increase from the radially inner side to the radially outer side.

The centrifugal turbo machinery 1 of the first embodiment to the third embodiment is a pump, but may be another centrifugal machine. However, since the first to third embodiments are more effective for pumps, it is preferably configured as a pump. Further, in the first to third embodiments, the centrifugal turbo machinery 1 is configured as a multi-stage pump, but it may be formed as a single stage pump. However, in this case, the flow in the radial direction on the rear side of the impeller 2 is reversed in the single stage pump and the multi-stage pump.

In the first to third embodiments, the impeller is configured as a closed impeller having the disc 21 and the cover 23, but in another embodiment, the impeller may be an open impeller having no cover 23. In this case, the waveform portions 6, 106 and 206 are formed only on the front sides 34, 134 and 234 facing the rear side 25. Furthermore, the first to third embodiments are configured so that both the disc 21 and the cover 23 are provided, and the waveform portions 6, 106 and 206 are formed on both the front sides 34, 134 and 234 and the rear sides 32, 132 and 232. However, even when both the disc 21 and the cover 23 are provided, it is also possible to form the waveform portions 6, 106 and 206 only on one of the front sides 34, 134 and 234 and the rear sides 32, 132 and 232. However, it is preferable to form the waveform portions 6, 106 and 206 on the front side 34.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. A centrifuge turbo machinery comprising:

an impeller which rotates around an axis to pressure-feed fluid flowing along the axis to an outer side in a radial direction; and a casing which accommodates the impeller and has a facing surface facing the impeller in an axial direction, wherein a convex portion, which is relatively close to the impeller and extending in the radial direction, and a concave portion, which is relatively spaced apart from the impeller and extending in the radial direction, are alternately and continuously formed on the facing surface in a circumferential direction, wherein the impeller includes a disc fixed to a shaft for rotating the impeller, a plurality of blades provided on the disc, and a cover which covers the blade, and wherein the facing surface has a surface facing the disc in the casing in the axial direction, and a surface facing the cover in the casing in the axial direction.

2. The centrifuge turbo machinery according to claim 1, wherein the convex portion and the concave portion are formed in an entire region of a portion of the facing surface facing the disc and an entire region of a portion of the facing surface facing the cover.

3. The centrifuge turbo machinery according to claim 1, wherein the convex portion and the concave portion are formed only in a partial region of the facing surface facing the disc on a radially outer side in the radial direction and a partial region of the facing surface facing the cover on a radially outer side in the radial direction.

4. A centrifuge turbo machinery comprising:

an impeller which rotates around an axis to pressure-feed fluid flowing along the axis to an outer side in a radial direction; and a casing which accommodates the impeller and has a facing surface facing the impeller in an axial direction, wherein a convex portion, which is relatively close to the impeller and extending in the radial direction, and a concave portion, which is relatively spaced apart from the impeller and extending in the radial direction, are alternately and continuously formed on the facing surface in a circumferential direction, and wherein an inclination from a bottom end of the concave portion to a protruding end of the convex portion of the impeller in the rotational direction is greater than an inclination from a protruding end of the convex portion to a bottom end of the concave portion of the impeller in the rotational direction.

* * * * *